US006921164B2

(12) United States Patent
Morgan et al.

(10) Patent No.: US 6,921,164 B2
(45) Date of Patent: Jul. 26, 2005

(54) UNDERWATER VIEWING LENS

(75) Inventors: William B. Morgan, Santa Barbara, CA (US); Connie L. Morgan, Santa Barbara, CA (US); Trent M. Schultz, Goleta, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 0 days.

(21) Appl. No.: 10/235,589

(22) Filed: Sep. 4, 2002

(65) Prior Publication Data

US 2004/0051973 A1 Mar. 18, 2004

(51) Int. Cl.[7] ..... A63B 33/00; A61F 9/04

(52) U.S. Cl. ..... 351/43; 2/430; 2/439; 2/449

(58) Field of Search ..... 351/43; 2/426–428, 2/431, 439, 449, 430

(56) References Cited

U.S. PATENT DOCUMENTS 3,787,113 A * 1/1974 Shedrow ..... 351/43
4,610,036 A * 9/1986 LaPrairie ..... 2/12
5,000,558 A * 3/1991 Blackstone ..... 351/41
6,082,857 A * 7/2000 Lockhart ..... 351/178
6,341,863 B1 * 1/2002 Chen-Lieh ..... 351/43
6,374,424 B1 * 4/2002 Tredup ..... 2/427
6,532,603 B1 * 3/2003 Lan ..... 2/428
6,685,316 B2 * 2/2004 Baumbach et al. ..... 351/169

FOREIGN PATENT DOCUMENTS

EP 860184 A1 * 8/1998 ..... A63B/33/00

OTHER PUBLICATIONS

Translation of European Patent EP 0 860 184 A1, which was cited in the Office action of Oct. 12, 2004.*

Merriam–Webster's Collegiate Dictionary, Tenth Edition, 1998, pp. 45 and 864.*

* cited by examiner

*Primary Examiner*—Scott J. Sugarman
*Assistant Examiner*—Deborah Raizen
(74) *Attorney, Agent, or Firm*—Cislo & Thomas LLP

(57) ABSTRACT

A viewing lens that is divided into at least three sections such that a wearer can see through a center section with both eyes, and can see through a lateral section only with the eye immediately adjacent to that section.

18 Claims, 14 Drawing Sheets

Proir Art

UNDERWATER VIEWING LENS

BACKGROUND OF THE INVENTION

1. Field of the Invention

This invention generally relates to diving equipment and more particularly to the viewing lens of the equipment that is being used by the diver to view objects in the water around them.

2. Description of the Related Art

Typical diving equipment that is used to view objects underwater is usually in the form of a mask (nose and eyes), full face mask (mouth, nose, and eyes), or helmet (entire head). Masks and full face masks generally have a soft seal that conforms to the divers face and has a viewing lens which consists of transparent window(s).

A flat single pane lens must be used in front of the diver's two eyes at every point that both eyes can see through. If there are two or more panes that both eyes can see through, an additional image will be seen. Two panes will result in two images that the visual center of the brain has difficulty making sense of. This can result in nausea and dizziness. A curved lens will result in each eye looking through a different part of the curve. This also results in visual confusion, nausea and dizziness.

Optically correct lenses have been designed and manufactured but with little or no acceptance. All divers have learned to dive viewing through a flat, single pane lens. Once acclimated to the flat lens the corrected lens appears to be abnormal and confusing. Additionally, the corrected lens for underwater is out of focus in the air. This leaves the diver on the surface no choice but to remove the masks for vision requirements out of the water.

Divers have been taught that underwater objects appear to be only three-quarters as far away as their physical distance. For objects subtending small angles at the mask and eye it is true that, for any object distance, the objects in water virtual image produced by the air-water interface (lens) is always nearly 25% closer to the interface. This results in most objects appearing to be 25% closer to the relatively new diver. This is a consequence of the laws of refraction, sometimes referred to as "Snell's Law," as depicted in FIG. 1. Experience and acclimation can help overcome some of this perceived view.

The divers' vision is also limited by the size, shape and location of the viewing lens. Past attempts at improving the vision of the diver, especially peripheral vision, have mostly consisted of adding additional windows. For example, U.S. Pat. No. 5,345,615 discloses adding downward facing "pectoral region" windows to provide a degree of downward visibility. Most manufacturers also try to position the lens as close to the eyes as possible to help minimize the effects of refraction and to improve the visual field. See also U.S. Pat. No. 3,671,976 which teaches a frontal planar section with adjacent curved portions.

One of the problems with the current masks that have side windows is that the side windows are at too great of an angle (70° to 90°) when compared to the forward facing window. The results of this are, for example, that when the diver is observing an object that is moving from a side window to a front window or visa versa, especially when the object is more than 6" from the mask, the object disappears or partially disappears from the side window then reappears in the front window, creating a missing part of the total view between the two windows or a blind spot. The greater the angle the windows are to each other the more of the view between the windows is lost. In addition, the diver's eyes have difficulty focusing at these lateral angles so the visual information is limited.

Another problem with visibility is that a blind spot is also created by the plastic bar between windows in prior art masks. Recent attempts at removing this plastic bar between the windows have included that disclosed in Published Application U.S. 2002/0005931 A1, that discloses a mask where the windows are fashioned in such a manner that the sides and front windows are bonded together with a flexible glue, then molded into a plastic frame. The glue joint between the pieces of glass are cut and ground in a way that only a very thin line is visible to the user of the mask, similar to the early aviator's goggles, eliminating the plastic bar between the windows. This helps greatly out of the water. But underwater, because the windows are flat pieces of glass with cut and ground edges that are glued together, this creates an immediate and abrupt change in angles between the pieces of glass, and the blind spot remains, as depicted in FIG. 2.

SUMMARY OF THE INVENTION

The invention provides an underwater viewing lens that lessens the effects that refraction has to the view of the diver, eliminates the blind spot between the front and side window and enables the user of the lens to have a more accurate perspective of the location of objects in the water around them.

Most current diving masks that have side windows are manufactured by molding individual glass windows into a plastic frame that is in one form or another attached to the mask seal. This molding technique creates a bar of plastic between the front and side windows that help hold the windows in place. This bar of plastic adds to the blind spot seen by the diver.

This invention eliminates the blind spot by using a single center, planar piece of glass or transparent plastic material that is molded or otherwise formed with adjacent planar sections radially positioned thereto to form or define "transitional lines" or "spaced lines of division" between the planar center and lateral sections of the windowpanes of the lens. These transitional lines may minimally distort objects being viewed as they move from one windowpane to the next, but the color and connection of the object between windows is never lost and is more easily accepted visually because they do not disappear. In addition, the invention lessens the effects by reason of the fact that the blind spot and refraction are greatly reduced by the lateral windows being at a 10°–45° angle from the front window and the placement of the transition lines calculated from the distance of the lens to the eye in combination with the 15° cone of focus from the eye, (FIG. 5) bringing the lateral windows closer together and at a more acceptable angle so the eye can properly function.

Generally, the benefits of the invention are obtained underwater by reason that both of the diver's eyes are able to see through the center section of the viewing lens and the lateral sections of the viewing lens are used only by the eye on that specific side. The specifics of the transitional lines, that is the line between the planar center and lateral sections of the viewing lens, will be fully described hereinafter.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 3A:
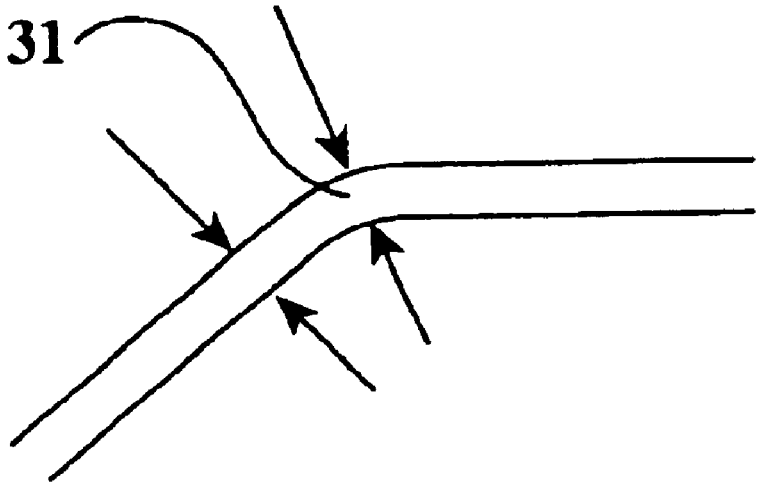
FIG. 3A is a schematic view of a portion of the device depicting the transitional line at the juncture of center and lateral section under optimum forming conditions.
Figure 3B:
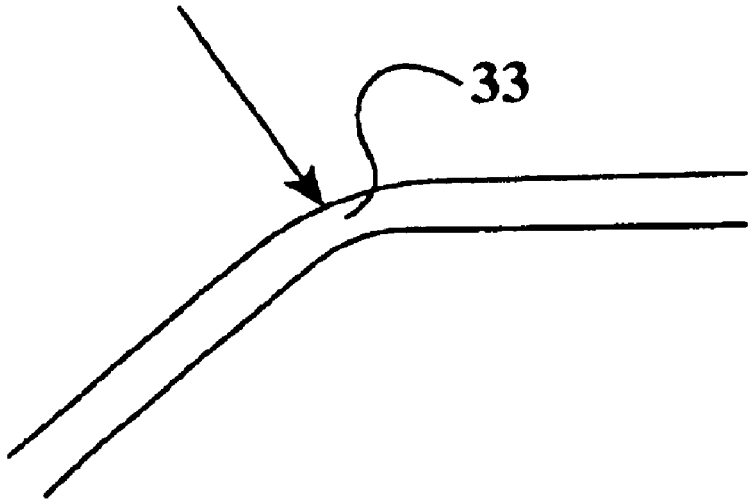
FIG. 3B is a schematic view of a portion of the device depicting transitional line distortion inherent in a forming process.

Referring to the figures of drawing wherein like numerals of reference designate like elements throughout, FIGS. 3A and 3B depict how the lens thickness at the transitional lines may vary depending on the method of manufacturing the lens 1. FIG. 3A depicts the result of a molding process where transitional line 31 maintains the same thickness as the rest of the lens as indicated by the distance between the arrows. In contrast, FIG. 3B illustrates a slight variance in thickness (at the arrow) that may occur at the transitional line area 33 if a bending, as opposed to a molding, method is used. In the bending method, the outside surface (at the arrow) is stretched, thus varying the thickness of lens 1 at 33. In either case however, there is not a blind spot at the transitional areas 31 and 33 of lens 1.

Figure 4:
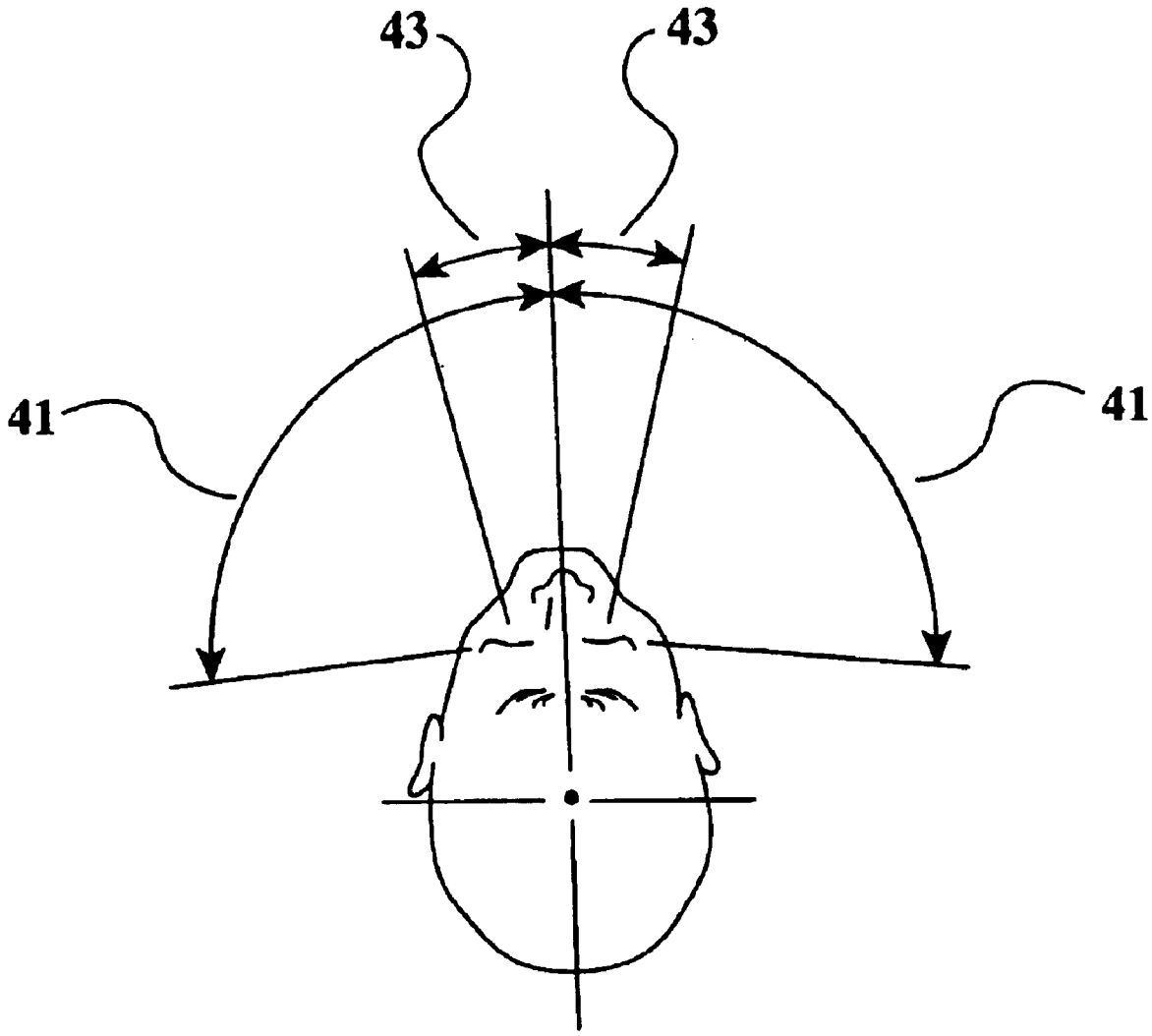
FIG. 4 is an elevation view of the cone of vision for a human being.

FIG. 4 illustrates a typical field of vision for a human being (which at maximum is about 95°), and contrasts an overall field of view 41 with an optimum, or "in focus" (15°) field of view 43.

Figure 5:
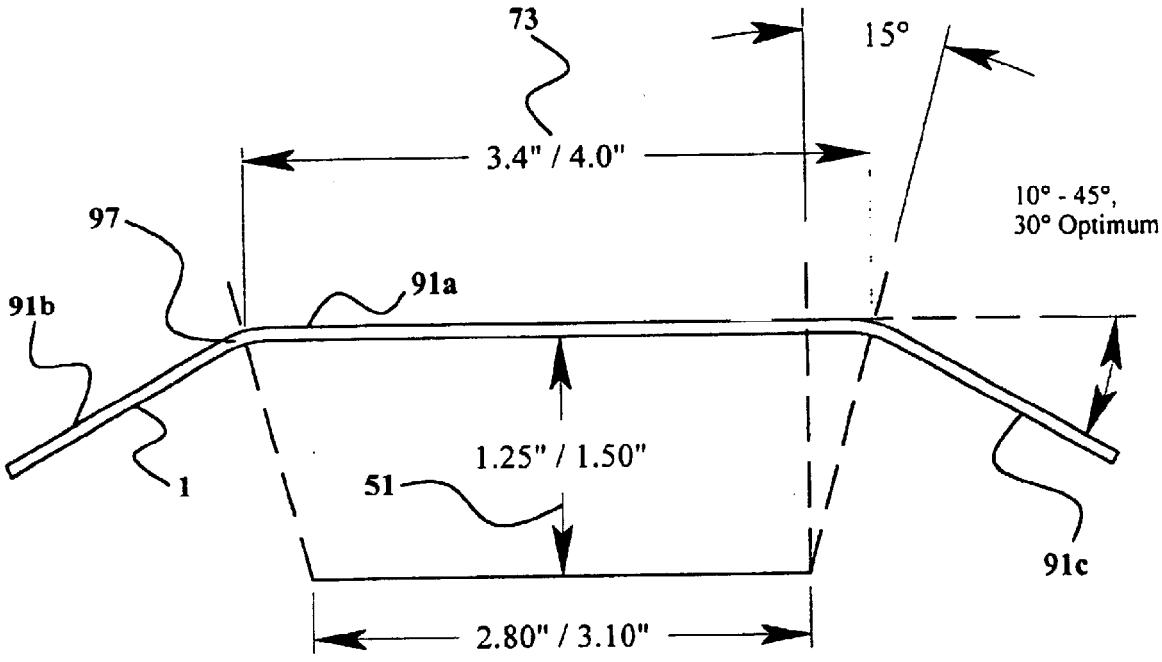
FIG. 5 is a schematic view of an exemplary embodiment of the invention configured for a typical user and depicting a method of calculating the transitional line distance between the planar sections of the inventive device.

FIG. 5 depicts the mathematics of how to compute the distance between the transitional lines. FIG. 5 also depicts the invention application to the typical field of vision where transitional lines 97 are placed to encompass the optimum field of view, and the distance of the lens from the eyes 51 is selected for maximum clarity as more fully explained hereinafter.

Figure 6:
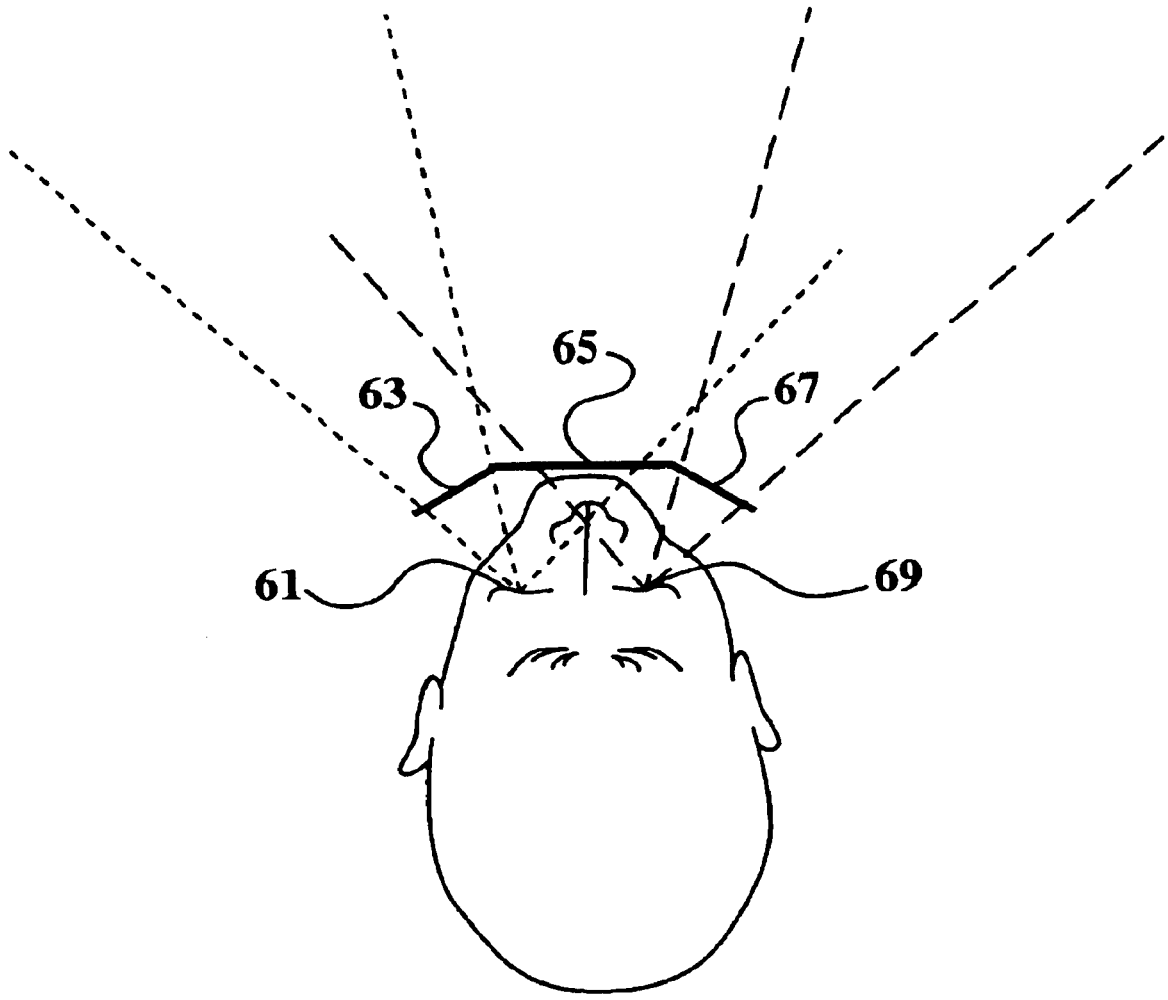
FIG. 6 is a schematic illustration of an embodiment of the lens portion of the device in use with a user.

FIG. 6 is a schematic that illustrates how the invention segregates the eyes with respect to different lens sections, the dotted lines showing the direction of viewing for each of the eyes. For example, left eye 61 can view through sections 63 and 65, but not through section 67. Similarly, right eye 69 can view through sections 67 and 65, but not through section 63. However, both eyes can see through center section 65.

Figure 7:
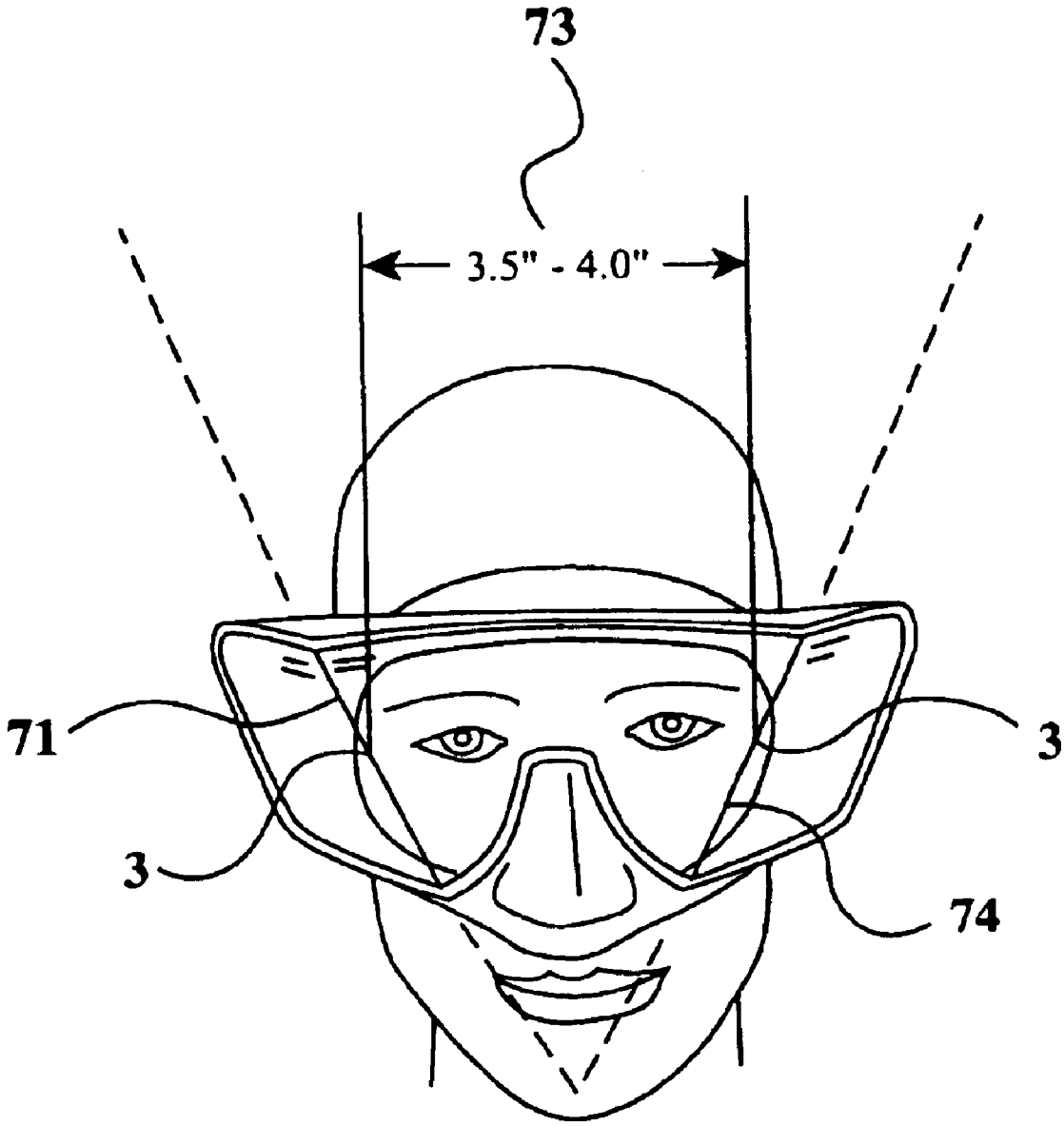
FIG. 7 is a front view of an embodiment of the invention with a "V"-shaped center section and illustrating the location of where to calculate the transitional line distance between lens portions on a "V" shaped lens.

FIG. 7 is a frontal view of an embodiment of the invention with angled transitional lines 71 and 74. The distance between the transitional lines is calculated the same as shown in FIG. 5, then applied to the lens at the same level as the eyes, usually around the mid point of the lens. The approximate midpoints 3 of the transitional lines 71 and 74 is preferably between approximately 3.5 inches and 4.0 inches, as shown at 73.

Figure 8:
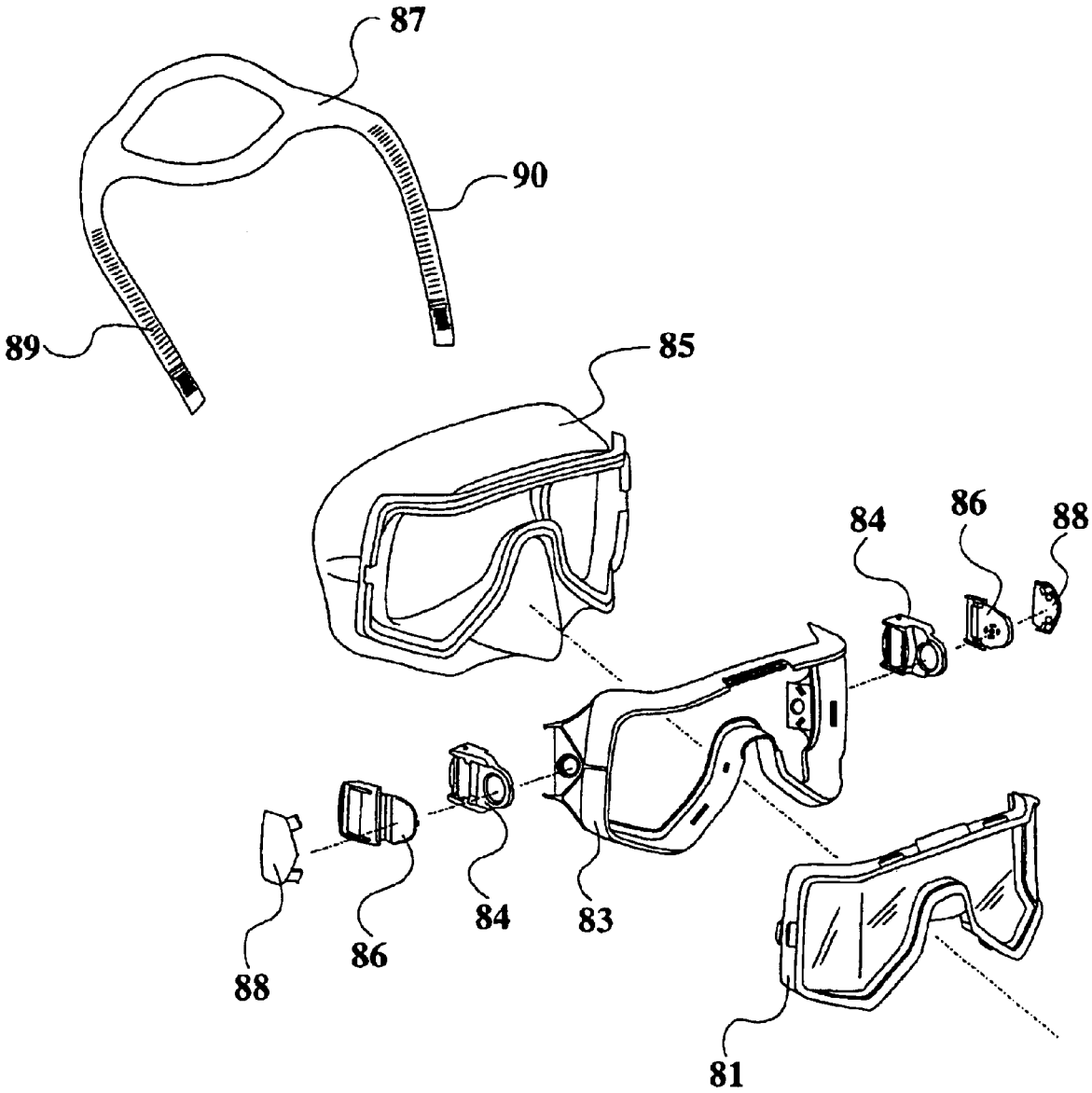
FIG. 8 is an exploded view of an embodiment of the invention as applied to a scuba diving mask.

FIG. 8 depicts an exploded view of a vertical transitional line embodiment of the invention as applied to a diving mask. Head harness 87 may be constructed of a natural or polymeric material, and has straps 90 with spaced ribs 89 for adjustable and operable attachment with buckle assembly parts 84 and 86. Lens 81 is attached to lens retainer 83 in a conventional manner, and the lens/lens retainer combination is attached to seal 85 in a manner known to those in the art, for example, bonding or capturing. Lens retainer 83 includes a fastening device including buckle roller 84, buckle release 86, and buckle cap 88 that combines with ribs 89 of straps 90 to secure the diving mask to the wearer's head.

Figure 9:
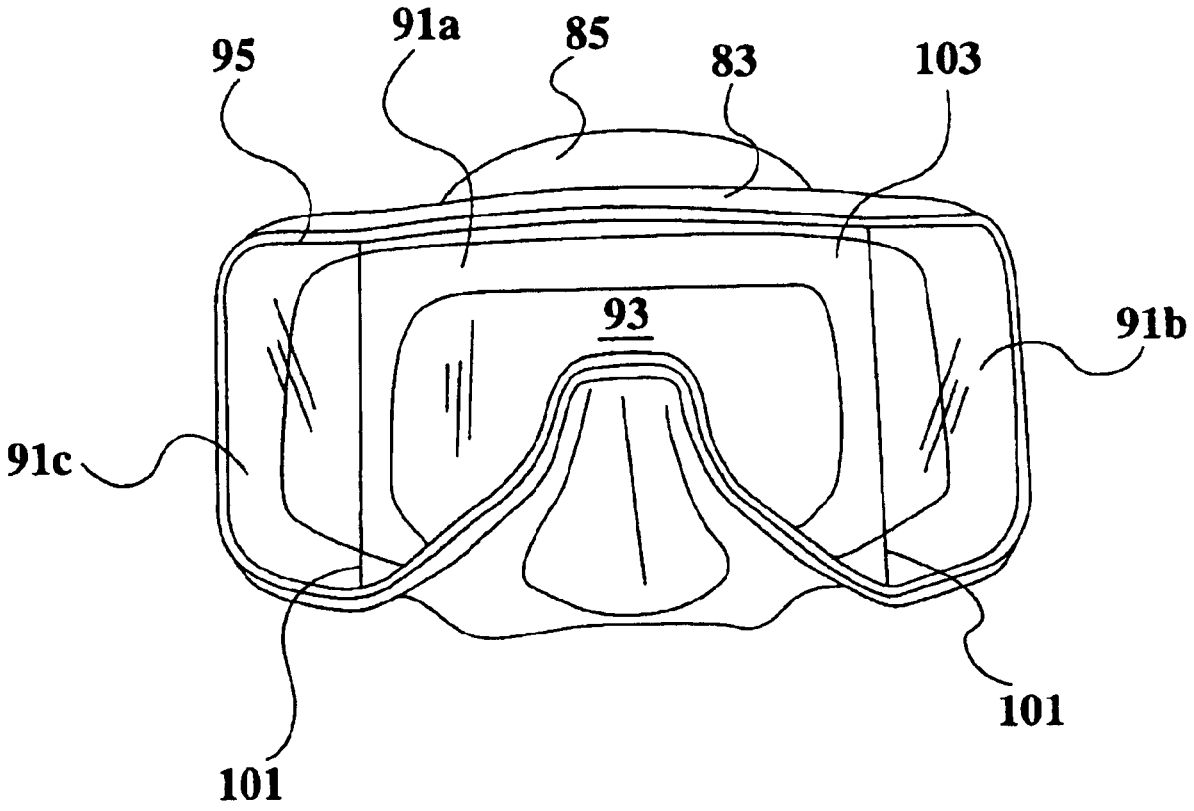
FIG. 9 is a frontal view of an embodiment of the invention with vertical transitional lines.

Referring to FIG. 9, the viewing lens 103 comprises a planar transparent pane 91, that includes a vertical surface 93 an upper horizontal edge 95, and transitional lines 97 that divide planar pane 91 into center section 91*a*, and planar lateral sections 91*b*, and 91*c*. Preferably, transitional lines 97 are approximately between 3.4 and 4.0 inches apart. Referring now to FIG. 5, and applying the teachings thereof, it will be seen that lateral planar Sections 91*b* and 91*c* are preferably offset from planar center section 91*a* at an angle between approximately 10° and 45°, with 30° being optimum. Transparent planar pane 91 of viewing lens 1 should be positioned between approximately 1.00 and 1.5 inches from the eyes when in use.

Figure 10:
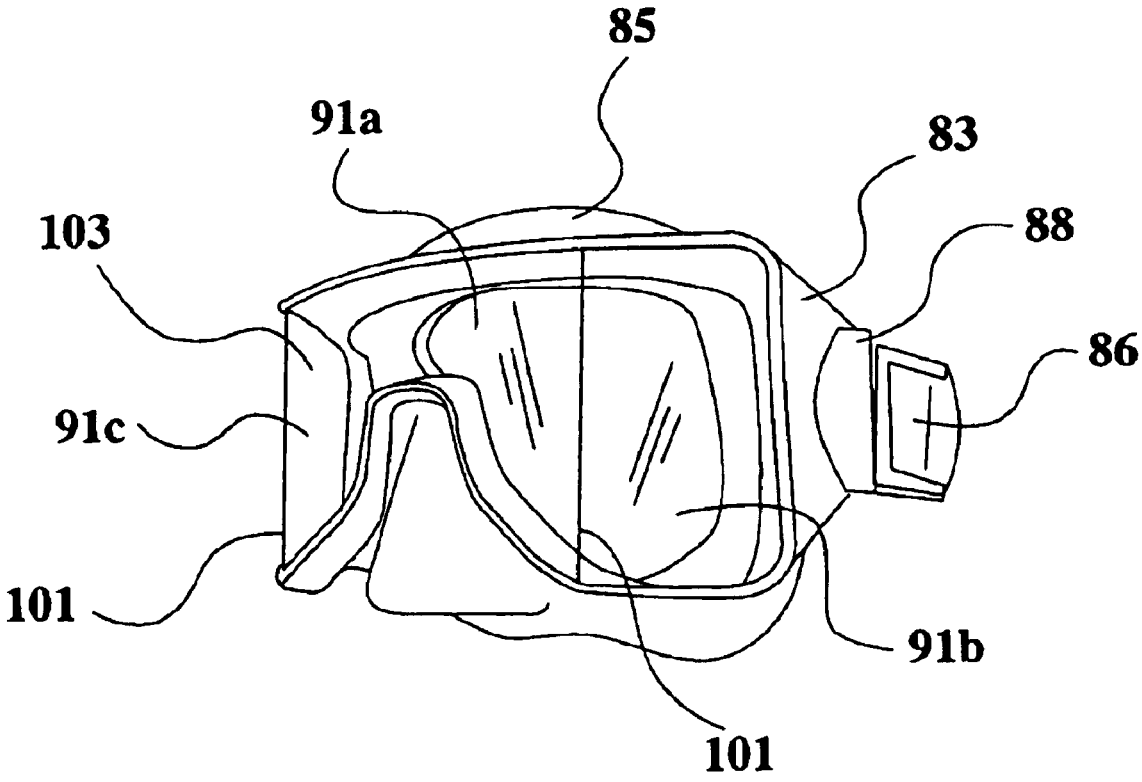
FIG. 10 is a perspective view of an embodiment of the invention with vertical transitional lines.
Figure 11:
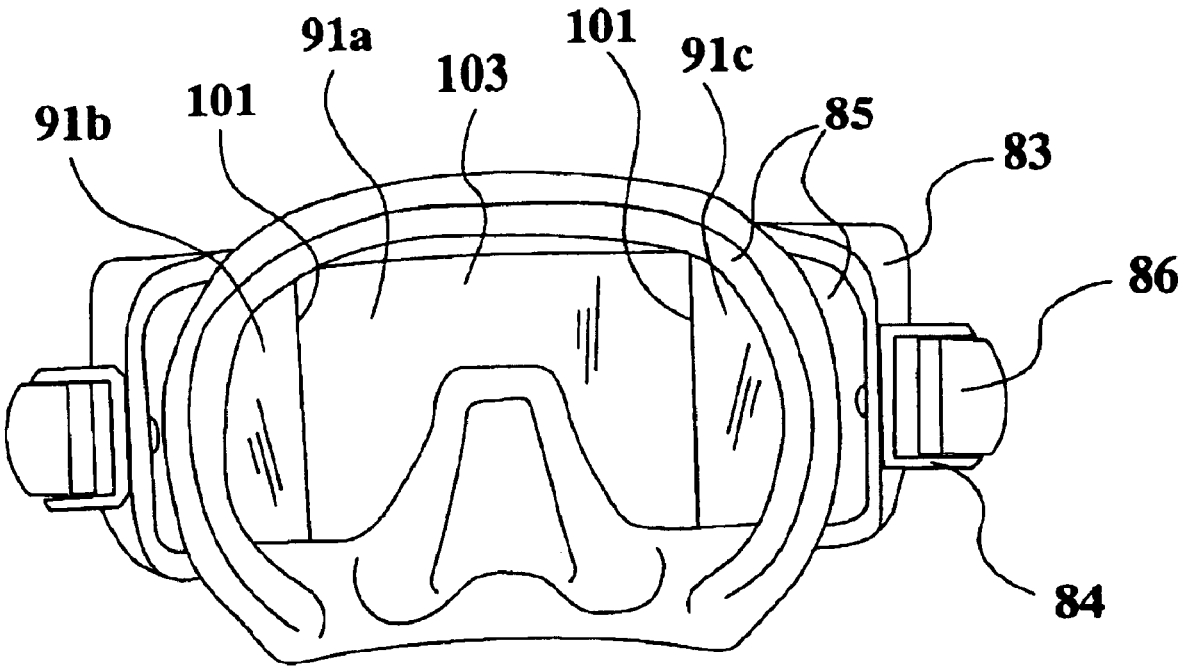
FIG. 11 is a rear view of an embodiment of the invention with vertical transitional lines.

FIG. 10 is a perspective view of the embodiment of the invention depicted in FIG. 9 with vertical transitional lines 101 on a lens 103. FIG. 11 is a rear view of the embodiment of the invention depicted in FIGS. 9 and 10.

Figure 12:
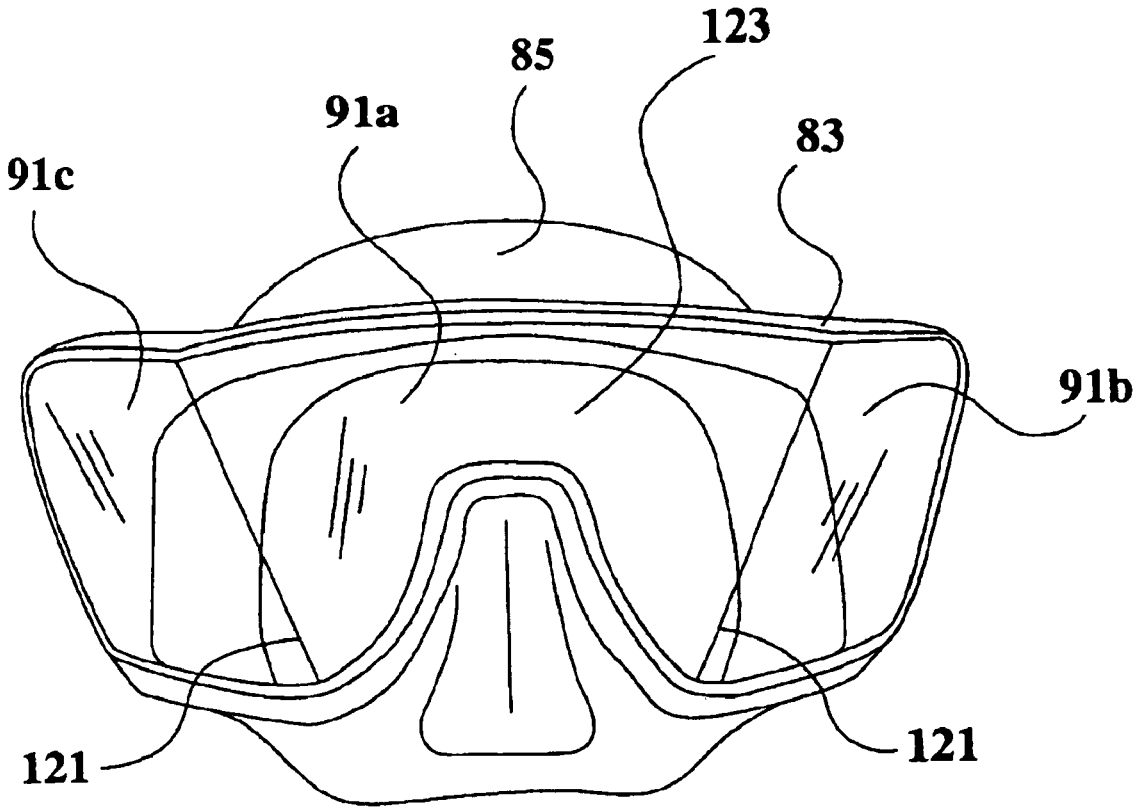
FIG. 12 is a frontal view of an embodiment of the invention with angled or radially positioned transitional lines.
Figure 13:
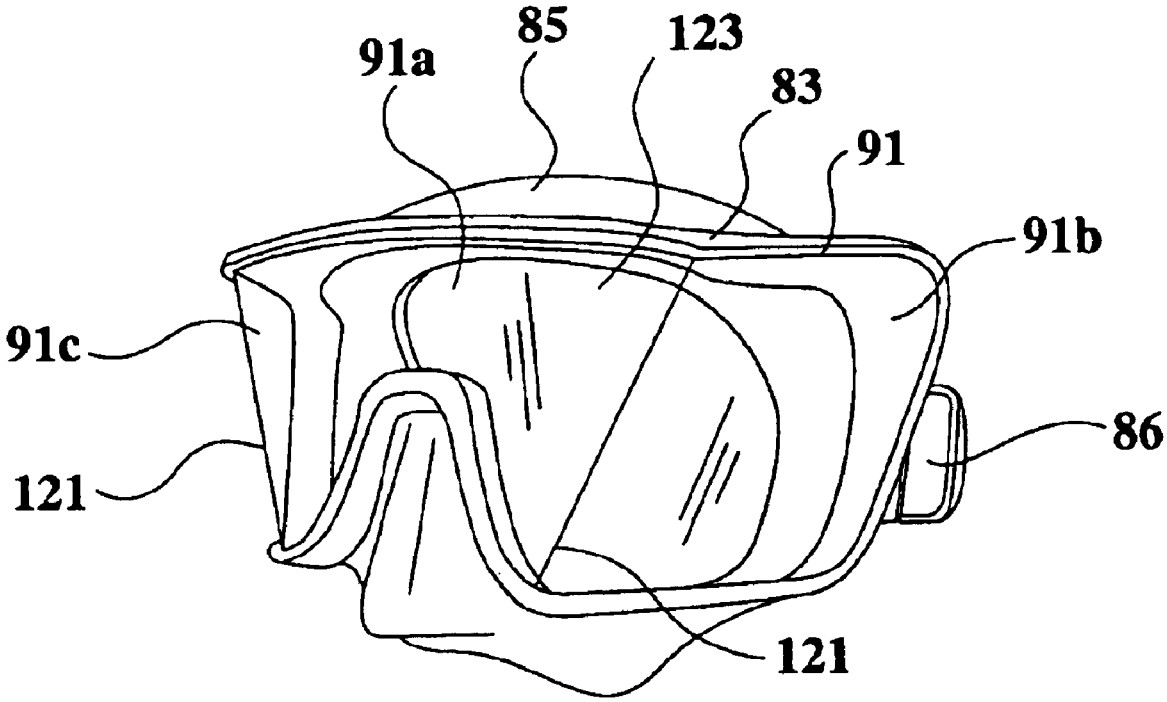
FIG. 13 is a perspective view of an embodiment of the invention with angled or radially positioned transitional lines.
Figure 14:
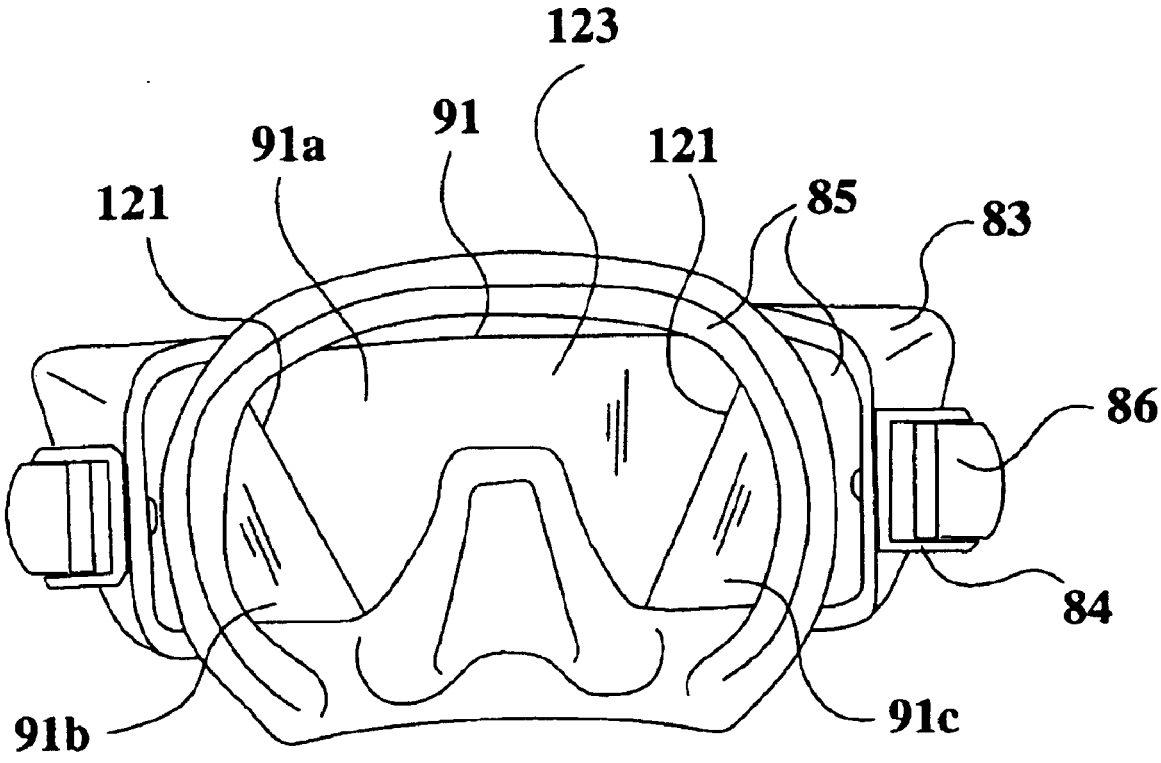
FIG. 14 is a rear view of an embodiment of the invention with angled or radially positioned transition lines.

FIGS. 12, 13, and 14 depict an alternative embodiment where the transitional lines 121 are radially positioned or angled approximately 120° inward as measured from a lateral portion of the horizontal edge, which results in the transitional lines forming a "V" shaped center section 123.

The preferred method of manufacturing the viewing lens of this invention is by molding a single transparent lens made up of a planar center section and adjacent planar lateral sections. Obviously one may use two center sections of non-unitary construction and still obtain the benefits of the invention. The unitary molded lens ensures a constant uniform thickness of the portion of the lens and transitional line portions thereof. The lens thickness is preferably between approximately 0.03–0.25 inches. Where a bending formation process is used the radius of the bends at the transitional line should be between about 0.15–0.25 inches to diminish distortion.

Figure 1:
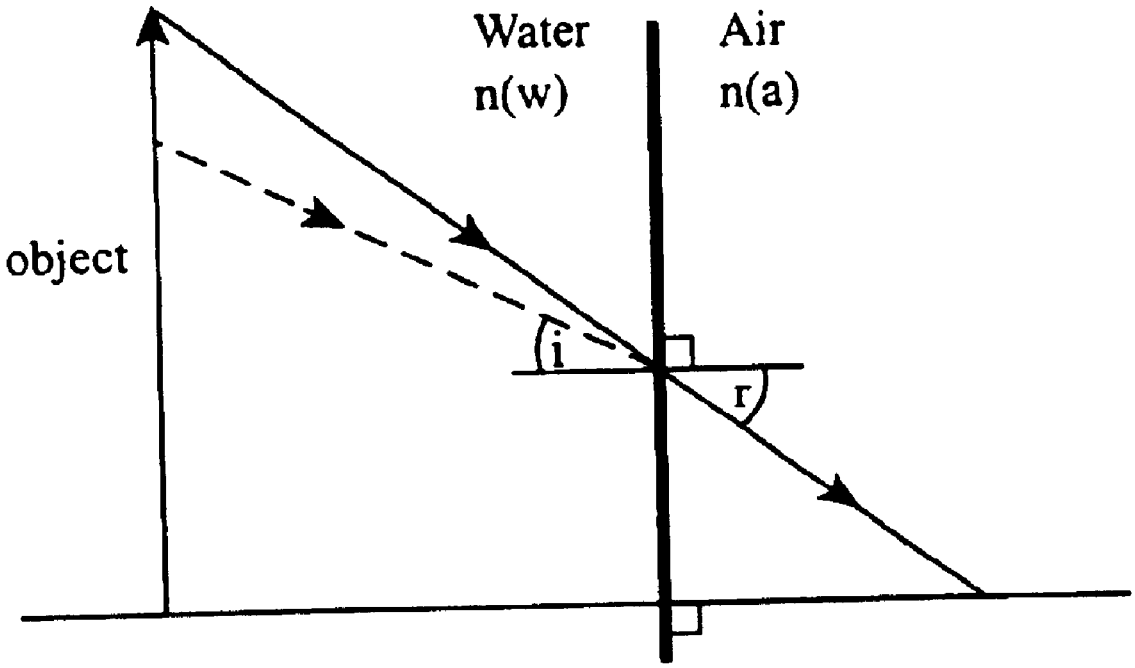
FIG. 1 is a graphical depiction of Snell's Law.
Figure 2:
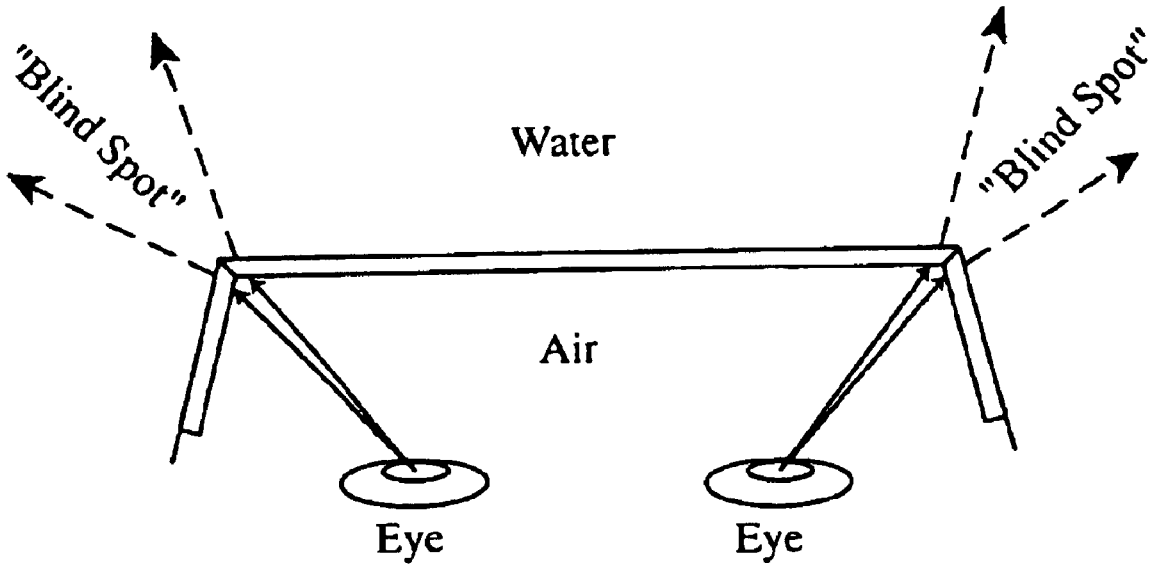
FIG. 2 is an elevation view of a prior art device.

To better understand the invention, a reference to FIG. 1 and Snell's Law will be desirable.

Snell's Law states:

$$\sin(i)=[n(a)/n(w)]\sin(r)$$

Where n(a) and n(w) are the indices of refraction, respectively, of air and water. Since the ratio n(a)/n(w) is approximately 0.75 angle 'i' is always smaller than angle 'r', and the lens' effective field of view is smaller. If the lens is very close to the interface, its effective angular field of view is '2i'. Some typical values are shown below (angles in degrees).

| | | | | | |
|---|---|---|---|---|---|
| in-air angular filed of view | 180 | 140 | 100 | 60 | 30 |
| in-water angular filed of view | 97 | 90 | 70 | 44 | 22 |

For example the underwater field of view of a 180° 'fisheye' lens is only 97° behind a plane or pane lens.

Through research of human factors data and personal testing it has been determined that the optimum field of view for a human, that is, the area which is in focus and where most people concentrate, is an approximately 15° conic section oriented about the eyes, as shown in FIG. 4. It has also been determined through research of human factors data that the average distance between pupils of the average human is 2.8"–3.1". This invention when applied to diving masks keeps the viewing lens as close to the eyes as possible to lower the volume of air space within the mask and to help lessen the effects of refraction. Somewhere between 1.00–1.5 inches from the eyes is optimum. When calculating the distance between the transitional lines on the lens the outer limits of the 15° angle oriented about a pair of eyes that are approximately 2.8–3.1 inches apart, and extrapolating that to the viewing lens that is 1.00"–1.5" from the eyes, the distance between these two intersecting points on the lens is between about approximately 3.40–3.50 to 4.00 inches. (See FIG. 5) This is an optimal location for the placement of the "transitional lines", as described above.

Placement of the "transitional lines" between the front and side windows at parameters corresponding with the cone of vision improves the diver's vision. In prior art conventional masks, with an average front window width of 5.0–5.25 inches, the diver's arms are usually viewed at the outermost parts of the front viewing window and therefore are in the greatest refractory zone. Consequently, this causes the diver to have some confusion as to the position of the arms, hands and other objects in the outermost parts of the window, because they do not visually appear where they actually are. By narrowing the width of the front planar windowpane and positioning the planar side window panes at a more acceptable (10°–45°, with 30° being optimum) angle relative to the center pane, arms, hands and other objects are usually viewed in one of the lateral windowpanes. Because the lateral windowpanes are closer to the center and at an angle such that the plane defined by the windowpane is nearly parallel to a straight line of sight to the object being viewed in that specific lateral window, the effects of refraction are reduced. Further, having the transitional lines closer together (towards the center of the front lens section) and the side window sections at a more acceptable angle (10°–45°, with 30° being optimum as compared to the front window pane section) allows the eye to be able to focus through the respective side window section without straining the eye. This combination of factors, i.e. planar sections making up the lens, position of the transitional lines, angles of the lateral sections relative to the center section(s) and geometry of placement, produces a more accurate image in all sections of the windows as to the position and distance of objects in the water, and is more easily viewed without eyestrain.

In addition, only the front or center windowpane section (s), which must be flat or planar, will allow both eyes to view through it. The side windowpane sections must also be planar and positioned so that the nose of the face prevents the eye(s) from viewing the side windowpane sections of the opposite side of the mask. In other words, the left eye is the only one that can view through the left side windowpane section and the right eye is the only one that can view through the right side windowpane section. At no time can both eyes view through one of the side windowpane sections, as shown in FIG. 6.

Referring again to FIG. 7, transitional lines 71 and 74 on the front window section are angled or medially positioned. This angle is around 120° and is an inward sloping angle from the top outside edges of the front window, in effect creating a general "V" shaped center window with the eyes positioned between the "V". The optimum position for determining the distance between the transitional line is measured approximately ½ of the way up the "V". Therefore the upper part of the front windowpane is wider, for example, approximately between 4.5–5.0 inches, and the lower part of the front windowpane can be much narrower, approximately between 2.5–3.0 inches. The same rule, as previously mentioned above, still applies. This is possible due to the vision blockage of the nose. Furthermore, by angling the transitional lines on the front windowpane it places the side windowpanes at an inward (towards the face) and downward facing angles. This combines a side view and a downward view in the same window, something no other mask or lens can do.

While the present invention is particularly effective when used underwater, it may also be used in conjunction with other activities, such as motor sports, welding, or any activity where eye protection and visibility are needed simultaneously.

While the present invention has been described with regards to particular embodiments, it is recognized that additional variations of the present invention may be devised without departing from the inventive concept disclosed herein.

What is claimed is:

1. A viewing lens, for providing a barrier between eyes and an environment, comprising:

a transparent pane having a vertical surface and upper horizontal edge, said pane having at least two spaced lines of division for dividing said pane into at least one planar center section and two planar lateral sections, said planar lateral sections being angularly disposed relative to said planar center section, wherein the planar center section and two planar lateral sections are unitary and are within an individual's field of vision and said planar lateral sections are offset at an angle of between approximately 10°–45° from a plane defined by the vertical surface of said planar center section.

2. A viewing lens, for providing a barrier between eyes and an environment, comprising:

a transparent pane having a vertical surface and upper horizontal edge, said pane having at least two spaced lines of division for dividing said pane into at least one planar center section and two planar lateral sections, said planar lateral sections being angularly disposed relative said planar center section;

wherein the planar center section and two planar lateral sections are unitary and within an individual's field of vision;

wherein said spaced lines of division form transition lines that allow visual color and connectability between said planar center section and said planar lateral sections which are between approximately 3.5 and 4.0 inches apart; and said planar lateral sections are offset at angle of between approximately 10°–45° from a plane defined by the vertical surface of said planar center section.

3. The viewing lens of claim 2 wherein each of said planar center sections rests between approximately 1.00 inches and 1.5 inches from a respective eye.

4. The viewing lens of claim 3 wherein said transitional lines are angled and define a "V"-shaped center section.

5. The viewing lens of claim 4 wherein said transitional lines extend at an angle of approximately 120° inward as measured from the upper edge of said planar center section whereby the side and downward views are combined in said planar lateral sections.

6. The viewing lens of claim 5 wherein the pan is a unitary molded piece of transparent material.

7. The viewing lens of claim 6 wherein the pane has a constant thickness of between approximately 0.03 inches and 0.25 inches.

8. A method of viewing environmental objects comprising:

placing a lens between approximately 1.25 inches an 1.5 inches from an eye, said lens having at least one center section and two lateral sections defined by spaced transitional lines, said lateral sections being angularly disposed relative to said center section, said center and lateral section being unitary and planar and said lateral sections are offset at an angle of between approximately 10°–45° from a plane defined by a vertical surface of said center section.

9. A method of viewing environmental objects comprising:

placing a lens between approximately 1.25 inches an 1.5 inches from an eye, said lens having at least one center section and two lateral sections defined by spaced transitional lines, said lateral sections being angularly disposed relative to said center section, said center and lateral section being planar;

wherein said lateral sections are disposed at an angle between approximately 10°–45° relative to said center section.

10. The method of claim 9 wherein said transitional lines are substantially vertical.

11. The method of claim 10 wherein said transitional lines are angled.

12. The method of claim 11 wherein said transitional lines have an outward sweep of approximately 30°.

13. A viewing lens for an underwater diving mask or helmet that provides a transparent barrier between the eyes of the user and the environment, comprising:

a transparent pane having at least two, spaced transitional lines that divide said pane into at least one center section and two lateral sections, left and right, said lateral sections being angularly disposed relative to said center section and said at least one center section and said two lateral sections being planar;

wherein the lens is positioned so that only said at least one center section can be seen by both eyes and said lateral sections, left an right, can only be seen by the eye that is on the same side as the adjacent lateral section;

wherein said at least one center section of said viewing lens is approximately between 1.00 inches and 1.50 inches from the eye;

wherein the distance between said spaced transitional lines is approximately 3.5 to 4.0 inches; and wherein said lateral sections are offset at an angle approximately 10° to 45° from the plane defined by the surface of said at least one center section.

14. The viewing lens of claim 13 wherein said transitional lines are manufactured with a bend radius of about 0.15 to 0.25 inches.

15. The viewing lens of claim 14 wherein said spaced transitional lines are manufactured with the same uniform thickness as said front and lateral sections of the lens.

16. The viewing lens of claim 15 wherein said transitional lines are vertical.

17. The viewing lens of claim 15 wherein said transitional lines are spaced and are angled relative to said at least one center section.

18. The viewing lens of claim 17 wherein said spaced transitional lines are at an inward angle of approximately 120° defining a generally "V"-shaped center section of said lens.

* * * * *